United States Patent [19]

Houryu et al.

[11] 4,206,459

[45] Jun. 3, 1980

[54] NUMERAL DISPLAY DEVICE

[75] Inventors: Sakae Houryu, Yokohama; Mitsuaki Seki, Tokyo, both of Japan

[73] Assignee: Canon Kabushiki Kaisha, Tokyo, Japan

[21] Appl. No.: 830,339

[22] Filed: Sep. 2, 1977

[30] Foreign Application Priority Data

Sep. 14, 1976 [JP] Japan ..... 51-110044

[51] Int. Cl.[2] ..... G09F 9/32

[52] U.S. Cl. ..... 340/765; 340/756; 350/333; 340/799

[58] Field of Search ..... 340/324 R, 324 M, 336, 340/756, 763, 765, 798-800; 350/333, 336

[56] References Cited

U.S. PATENT DOCUMENTS

| | | | |
|---|---|---|---|
| 3,738,099 | 6/1973 | Tanaka | 350/333 |
| 3,781,863 | 12/1973 | Fujita | 350/336 |
| 3,831,166 | 8/1974 | De Nardo | 340/336 |
| 4,034,368 | 7/1977 | Shimomura | 340/336 |
| 4,078,374 | 3/1978 | Kondo | 340/324 M |
| 4,091,377 | 5/1978 | Shimoi | 350/333 |

OTHER PUBLICATIONS

*Twisted Nematic Displays for Multiplexing*, Kmetz, pp. 36 & 37.

*Primary Examiner*—Marshall M. Curtis

*Attorney, Agent, or Firm*—Fitzpatrick, Cella, Harper & Scinto

[57] ABSTRACT

A numeral display device has a first board member provided with a first group of pattern electrodes arranged to define a plurality of digits, each forming a figure eight pattern, the digits being arranged in an upper row and a lower row wherein for each digit the segment for the decimal point is electrically connected with at least a segment in the figure eight pattern while the other segments in said figure eight pattern are connected to display particular information, a second board member placed in facing relationship with said first board member and provided with a second group of pattern electrodes arranged to define a plurality of digits each forming a figure eight shaped pattern, the digits being arranged in an upper row and a lower row wherein for each digit the segment for decimal point is connected with at least a segment in the figure eight pattern other than those corresponding to the segments connected with the decimal point segment in said first board member while the other numerical segments are connected to display particular information, a displaying material provided between said first and second board members, and a circuit for providing the electrode groups in said first and second board members with respective drive signals thereby enabling display of different numerals in said upper and lower rows.

6 Claims, 9 Drawing Figures

NUMERAL DISPLAY DEVICE

BACKGROUND OF THE INVENTION 1. Field of the Invention

The present invention relates to a numeral display device adapted for use for example in an electronic desk-top calculator, and more particularly to a numeral display device capable of displaying numerals in multiple rows and to a numeral display device capable of providing a display with elevated contrast and with a simplified drive circuit.

2. Description of the Prior Art

The various display devices known in the prior art have inevitably been associated with the following drawbacks:

(1) They are unable to display numerals with decimal points in multiple rows with a simple construction:

(2) The conventional display devices, if simply constructed for the display of two rows, will result in a reduced display contrast due to the increased resistance of prolonged transparent leads:

(3) A display device for multiple-row display inevitably requires considerably complicated connections with an area necessary for the electric leads, which renders the compact arrangement of the upper and lower rows impossible:

(4) In the dynamic display method, a display device for a row of six digits for example usually employs a drive method with a duty time of 1/6, but the subdivision of drive time for each digit by a half employed in recent technology leads to a duty time of 1/12 with an accordingly further reduced contrast of display:

(5) Such method, requiring 12 electrodes in the above case, namely twice as many as the number of digits, becomes more unfavorable as the number of digits increases:

(6) The neighboring electrodes, if derived to a same direction, will be located excessively dense, will not be able to have enough respective areas and will pose difficulty in making connections with the external leads.

(7) In the dynamic display scheme, if the driving time interval for the segments forming the figure eight digits is not uniform, contrast of the display will not be uniform. Thus it is necessary to provide a uniform driving time interval for each segment.

SUMMARY OF THE INVENTION

The object of the present invention, therefore, is to provide a display device and a drive method therefor capable of resolving the above-mentioned drawbacks.

DESCRIPTION OF THE PREFERRED EMBODIMENTS

Figure 1:
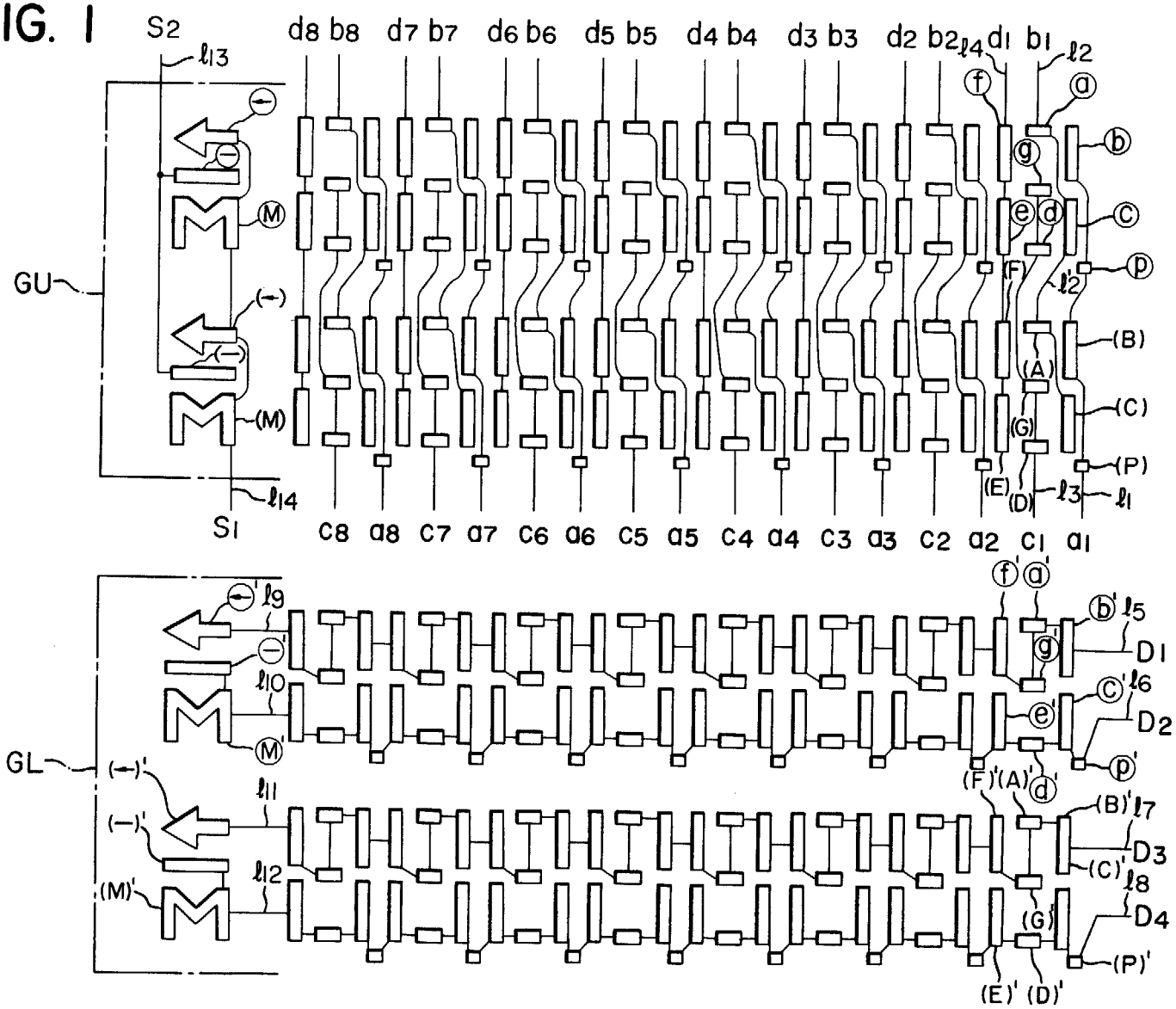
FIG. 1 is a plan view showing an embodiment of the display device of the present invention.

The display device shown in FIG. 1 is composed of two glass plates GU and GL placed in a mutually facing relationship, with a display material such as a liquid crystal interposed therebetween. As shown in FIG. 1, the glass plate GU is provided with numeral display units arranged in two rows, each composed of segments of a transparent electroconductive material, and arranged to form a figure eight pattern, with the segments for special symbols at the left-hand end of each row. In each figure eight shaped unit, the segments ⓑ and ⓟ, segments ⓐ and ⓒ, segments ⓖ and ⓓ, and segments ⓔ and ⓕ in the upper row are respective connected to each other by transparent electroconductive material, and likewise in the lower row the segments (B) and (P); and (A) and (C); (G) and (D); and (E) and (F) are respectively connected. Similarly connections are provided between the segments ⊖ and (M); and ⊖ and (M) at the left-hand end of the rows. Furthermore the connections are provided between the segments ⓟ and (B); and ⓒ and (A); ⓓ and (G); ⓔ and (F); ⊖ and (−); and Ⓜ and (←) so that the corresponding segments in the upper and lower rows can be activated simultaneously. The leads $1_1$ and $1_3$ for the segments are derived toward the lower side of the glass plate while the leads $1_2$ and $1_4$ are derived toward the upper side of said plate in order to avoid the drawback of excessive crowdedness mentioned above.

In the upper row of the other glass plate GL, the segments ⓑ', ⓐ', ⓖ' and ⓕ'; and ⓟ', ⓒ', ⓓ' and ⓔ' are respectively connected to one another and commonly throughout the same row. Likewise in the lower row the segments (B)', (A)', (G)' and (F)'; and (P)', (C)', (D)' and (E)' are respectively connected to one another and commonly throughout the same row. Also at the left-hand end, the segments ⊖' and (←)' are respectively connected through the leads $1_9$ and $1_{11}$ to the segments ⓕ' and (F)', and the segmets ⊖' and Ⓜ' and segments (−)' and (M)' are respectively connected through the leads $1_{10}$ and $1_{12}$ to the segments ⓔ' and (E)'. In this manner the upper and lower rows are respectively divided into two lines, and the resulting four lines are selectively driven through the leads $1_5$–$1_8$ by the drive pulse D1, D2, D3 and D4. The duty in the dynamic display method is thus ¼ regardless of the number of digits in a row, and this allows an extremely advantageous dynamic display.

Figure 2:
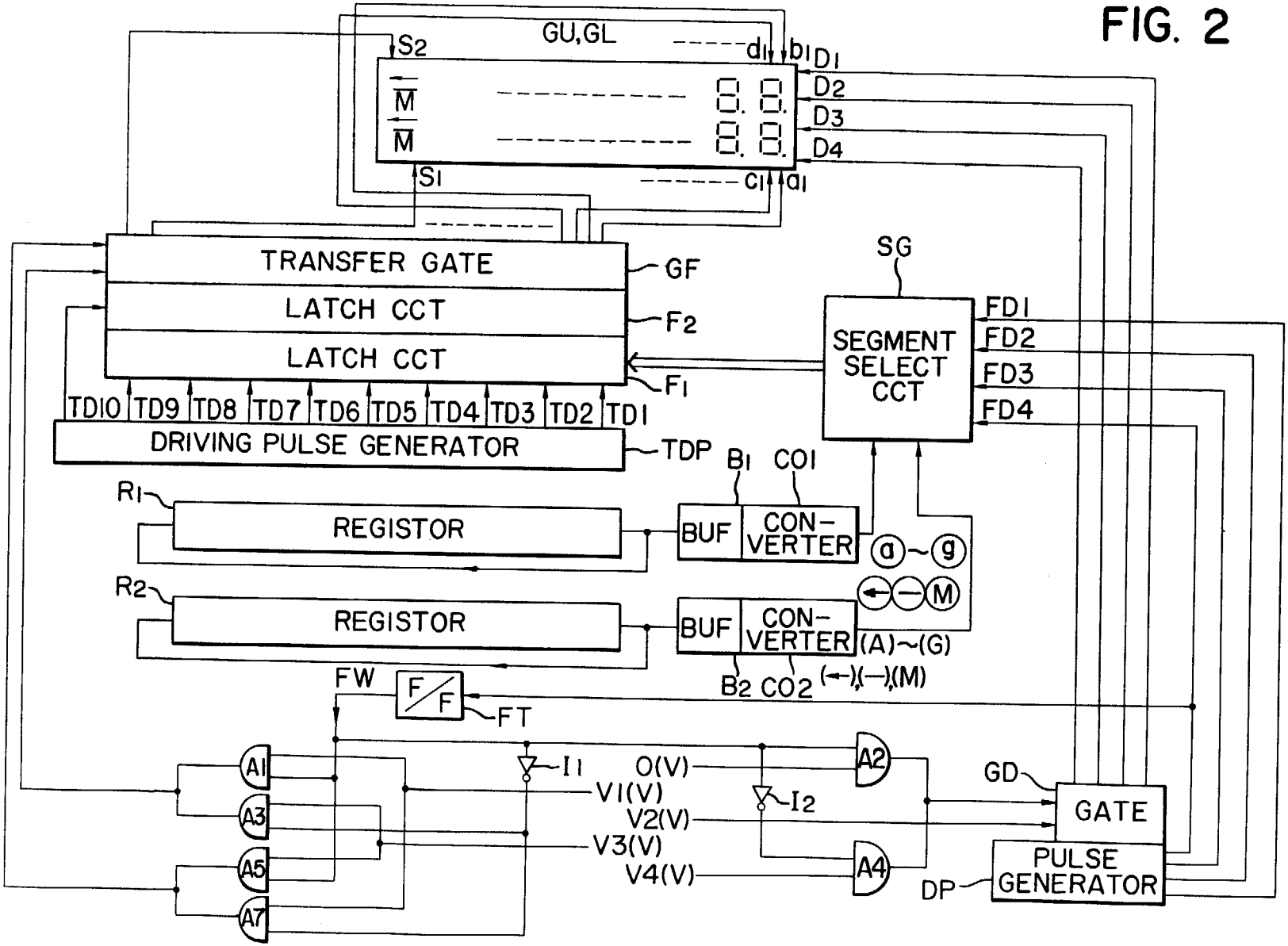
FIG. 2 is a block diagram of an example of the circuit for driving the display device shown in FIG. 1.
Figure 3A:
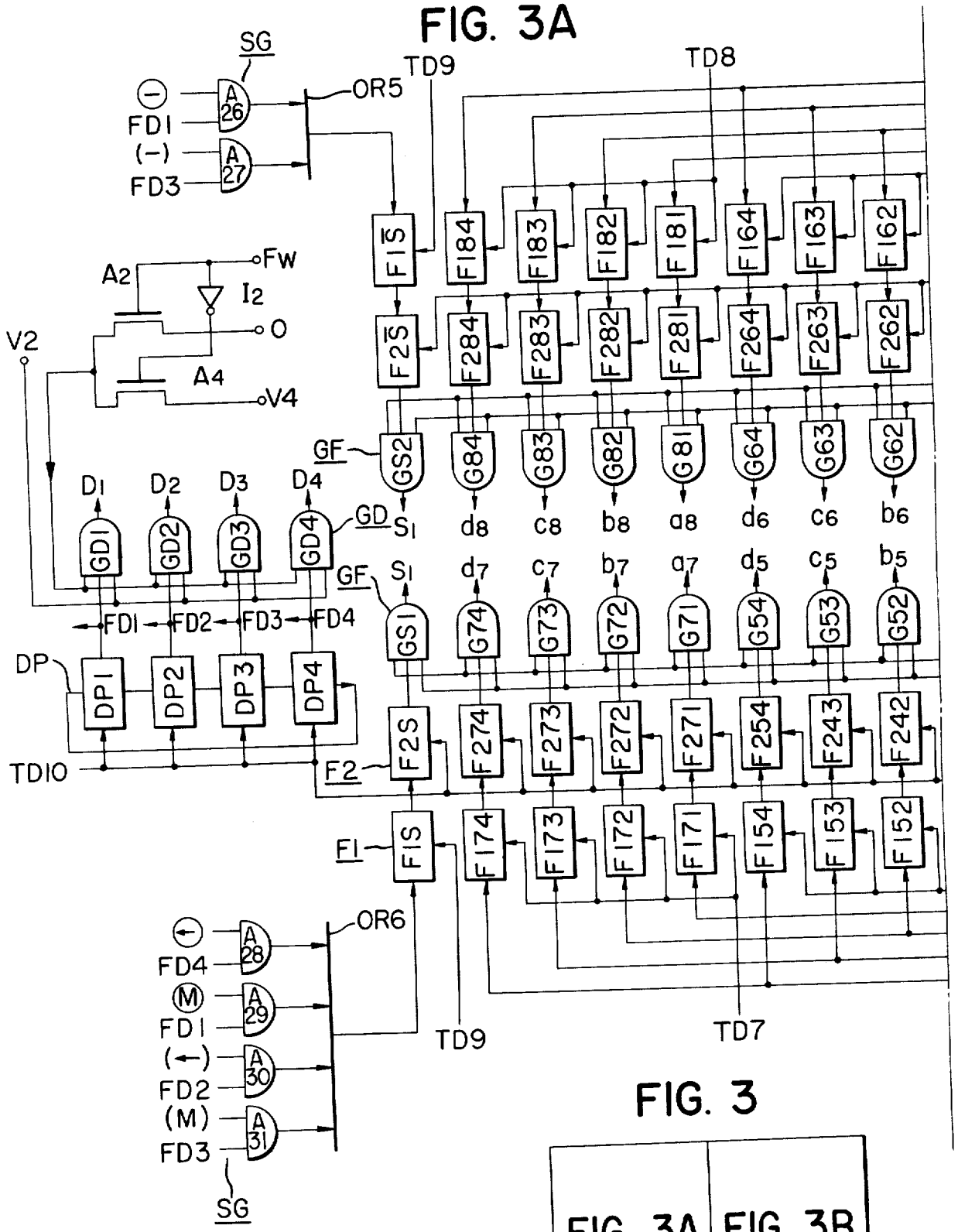
FIG. 3 illustrates a relation of FIG. 3A and FIG. 3B which show, in their combination, a detailed drawing of the circuit constituting a part of the circuit shown in FIG. 2.
Figure 3:
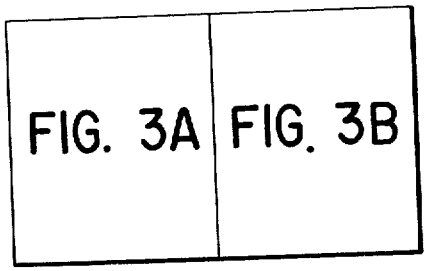
Figure 3B:
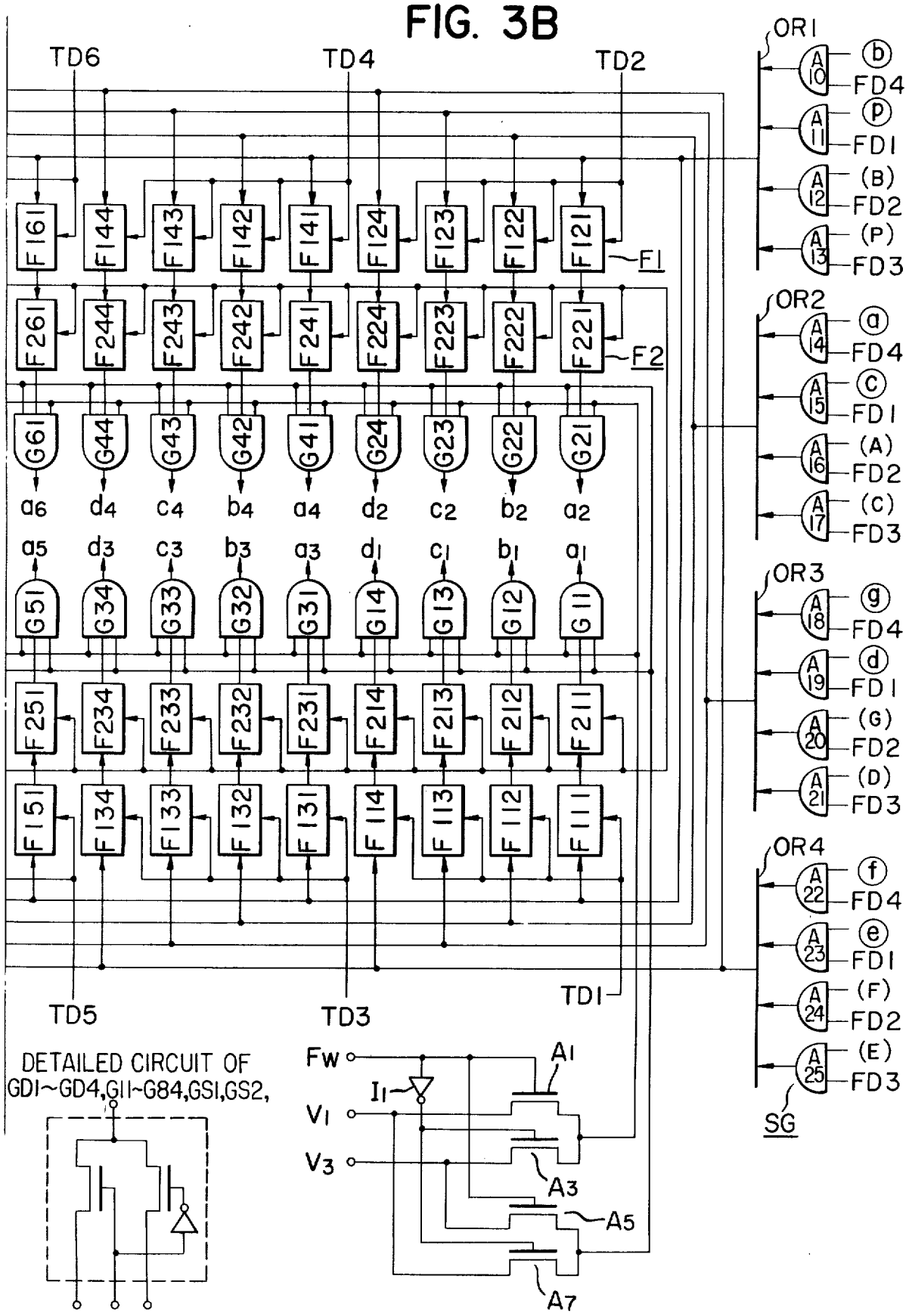
Figure 4:
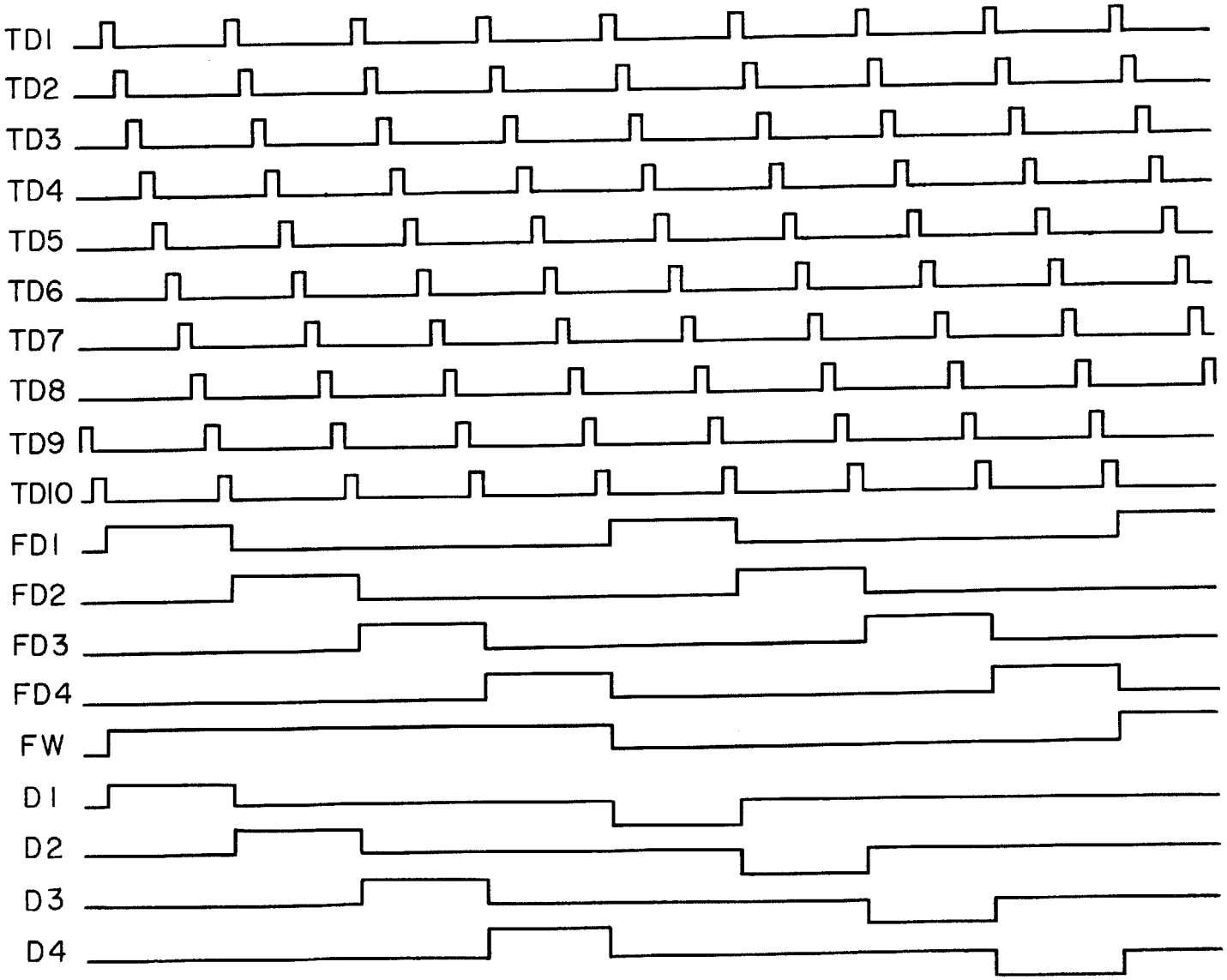
FIGS. 4 and 5 are wave charts illustrating the displaying function.

FIGS. 2 and 3 show an example of the circuit for the dynamic drive of the display device shown in FIG. 1 for two rows of numerals of eight digits each, wherein R1 and R2 are registers for storing and recycling the information to be displayed in the upper and lower rows respectively, said information containing numerals of eight digits and a symbol of 1 digit. B1 and B2 are one-digit buffer circuits; CO1 and CO2 are converters for converting the binary information of one digit in said buffers B1 and B2 into the information for selecting the segments in the figure eight display unit; DP is a pulse generator for generating drive pulses FD1–FD4 shown in FIG. 4; SG is a segment selecting circuit which selects the segment information from the converters CO1, CO2 upon receipt of said pulses FD1–FD4; F1 and F2 are latch circuits for temporary storage of the information of the register R1 and R2. The latch circuit F1 of a storge capacity of nine digits is structured to perform parallel transfer of information to the latch circuit F2 of the same capacity. The details of the pulse generator DP, segment selecting circuit SG and latch circuits F1, F2 are shown in FIG. 3. TDP is a pulse generator for generating pulse signals TD1–TD9 defining the timing of nine digits and a pulse signal TD10, according to the timing of which the information from the segment selecting circuit SG is stored in the latch F1. FT is a T-type flip-flop which is inverted at the end of each FD4 pulse and which generates an FW signal as shown in FIG. 4. Said FW signal instructs the timing of polarity inversion for extending the life of the liquid crystal display device, said inversion taking place in the illustrated example at each cycle of the signals FD1–FD4. GF, GD, A1–A5 and A7 are transfer gates which generate output signals of different levels according to the status of the said FW signal in order to invert the polarity of drive potential to the liquid crystal display device. A10–A31 are 'AND' gates for selecting segments; OR-1–OR6 are 'OR' gates; and I1 and I2 are inverters.

The pulse signal TD10 is applied to the units DP1, DP2, DP3 and DP4 of the pulse generator DP to cause the shifting of the content thereof, thereby causing to generate the pulse FD1, FD2, FD3 or FD4 for each cycle of pulses TD1–TD10. Also the content of the latch F1 is transferred at each pulse TD10 to the latch F2, which retains the content of the latch F1 during one cycle of the pulse TD10 and drives the segment pattern a1–S2 shown in FIG. 1 through the gates GF. The output of a gate GF is determined as shown in the following according to whether an input FW is 1 or 0 and whether another input from F2 is 1 or 0:

| FW \ F2 | 1 | 0 | |
|---|---|---|---|
| 1 | V3 | V1 | |
| 0 | V1 | V3 | (cf. FIG. 3). |

Also the outputs D1–D4 from the gates GD are determined in the following manner according to whether the input FW thereto is 1 or 0 and whether another input from DP is 1 or 0:

| FW \ DP | 1 | 0 | |
|---|---|---|---|
| 1 | 0 | V2 | |
| 0 | V4 | V2 | (cf. FIG. 3). |

Now there will be given an explanation for a case for example where the figures "12" and "34" are displayed in the upper and lower row respectively. In this case, therefore, the data "12" and "34" are respectively stored and circulated in the registers R1 and R2. The latch F1 is shifted to set state by scanning the data in the register R1 during the pulses FD4 and FD1, and also scanning the data in the register R2 during the pulses FD2 and FD3, and said data in the latch F1 is transferred to the latch F2 at the pulses TD10 between the pulses FD4 and FD1, FD1 and FD2, FD2 and FD3 or FD3 and FD4.

Upon receipt of the pulse FD4 and pulse TD1, the converter CO1 decodes the segment information ⓐ, ⓑ, ⓖ, ⓔ and ⓓ for the numeral "2" of lowermost digit in the register R1 and applies said information to the segment selecting circuit SG to open the gates A10, A14 and A18 shown in FIG. 3 thereby setting the latches F111, F112 and F113 for driving the segments ⓐ, ⓑ and ⓖ.

Upon receipt of the following pulse TD2, the converter CO1 decodes the segment information ⓑ and ⓒ for the numeral "1" of the next digit in the register R1 and applies said information to the segment selecting circuit SG to open the 'AND' gate A10 in FIG. 3 therey setting the latch F124 for driving the segment ⓑ. During the succeeding pulses TD3 to TD9, neither latches are set as there is no information to be displayed in the register R1.

Now at the pulse TD10 at the shifting from the pulse FD4 to FD1, the date stored in the latches F1 during the preceding pulse FD4 are transferred to the latches F2 to cause the display of the segments ⓐ, ⓑ and ⓖ in the first digit and the segment ⓑ in the second digit in the upper row during the period of pulse FD1.

Successively, upon receipt of the pulses FD1 and TD1, the converter CO1 decodes in the similar manner the segment information ⓐ, ⓑ, ⓖ, ⓔ and ⓓ for the numeral "2" to open the 'AND' gates A19 and A23 thereby setting the latches F113 and F114 for driving the segments ⓔ and ⓓ.

At the succeeding pulse TD2, the converter CO1 similarly decodes the segment information ⓑ and ⓒ for the numeral "1" to open the 'AND' gate A15 shown in FIG. 3 thereby setting the latch F122 for driving the segment ⓒ.

Now at the pulse TD10 at the shifting from the pulse FD1 to FD2, the data stored in the latches F1 during the preceding pulse FD1 are transferred to the latches F2 to cause the display of the segments ⓔ and ⓓ in the first digit and the segment ⓒ in the second digit in the upper row during the period of pulse FD2.

In this manner the numeral "2" is displayed in the first digit of the upper row as the segments ⓐ, ⓑ and ⓖ are driven during the pulse FD1 and the segments ⓔ and ⓓ are driven during the pulse FD2, and the numeral "1" is displayed in the second digit as the segment ⓑ and the segment ⓒ are driven respectively during the pulses FD1 and FD2.

Also upon receipt of the pulses FD2 and TD1, the converter CO2 decodes the segment information (B), (C), (F) and (G) for the numeral "4" for the lowermost digit in the register R2 to open the 'AND' gates A12, A20 and A24 shown in FIG. 3 thereby setting the latches F111, F113 and F114 for driving the segments (B), (F) and (G).

At the succeeding pulse TD2, the converter CO2 similarly decodes the segment information (A), (B), (C), (D) and (G) for the numeral "3" for the next digit of the register R2 to open the 'AND' gates A12, A16 and A20 thereby setting the latches F121, F122 and F123 for driving the segments (A), (B) and (G). During the succeeding pulses TD3–TD9, no latches F1 are shifted to set state as there is no information to be displayed in the register R2.

At the pulse TD10 at the shifting from the pulse FD2 to FD3, the data stored in the latches F1 during the preceding pulse FD2 are transferred to the latches F2 to cause the display of the segments (B), (F) and (G) in the first digit and the segments (A), (B) and (G) in the second digit of lower row during the period of pulse FD3.

Also upon receipt of the pulses FD3 and TD1, the converter CO2 similarly decodes the segment information (B), (C), (F) and (G) for the numeral "4" to cause setting of the latch F112 for driving the segment (C).

Further upon receipt of the pulses FD3 and TD2, the converter CO2 similarly decodes the segment information (A), (B), (C), (D) and (G) for the numeral "3" to cause the setting of the latches F122 and F123 for driving the segments (C) and (D).

At the pulse TD10 at the shifting from the pulse FD3 to FD4, the data stored in the latches F1 during the preceding pulse FD3 are transferred to the latches F2 to cause the display of the segment (C) in the first digit and the segments (C) and (D) in the second digit of lower row during the period of pulse FD4.

Figure 5:
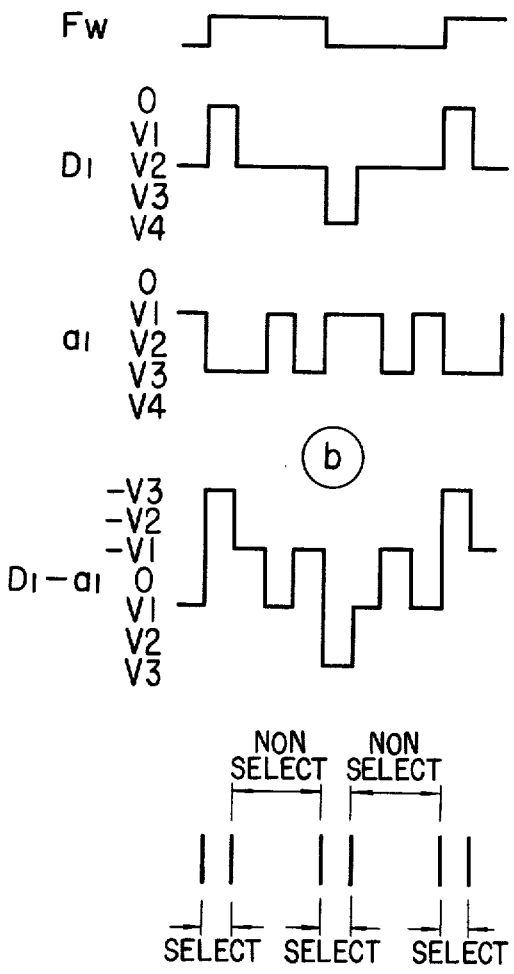

In this manner the numeral "4" is displayed in the first digit of the lower row as the segments (B), (F) and (G) and the segment (C) are respectively driven during the periods of pulses FD3 and FD4, and the numeral "3" is displayed in the second digit of the lower row as the segments (A), (B) and (G), and the segments (C) and (D) are driven respectively during the periods of pulses FD3 and FD4. Thus the numerals "12" and "34" are respectively displayed in the upper and lower rows during one cycle of pulses FD1 to FD4. The dynamic display is achieved by the repetition of the foregoing operations, and a liquid crystal display of high and uniform contrast as the drive period for each segment can be determined same (period between the succeeding pulses TD10 in the foregoing example). Also the lifetime of the liquid crystal is prolonged as the polarity is inverted at each pulse FW. As an example FIG. 5 shows the display and polarity inversion of segment ⓑ.

Figure 6:
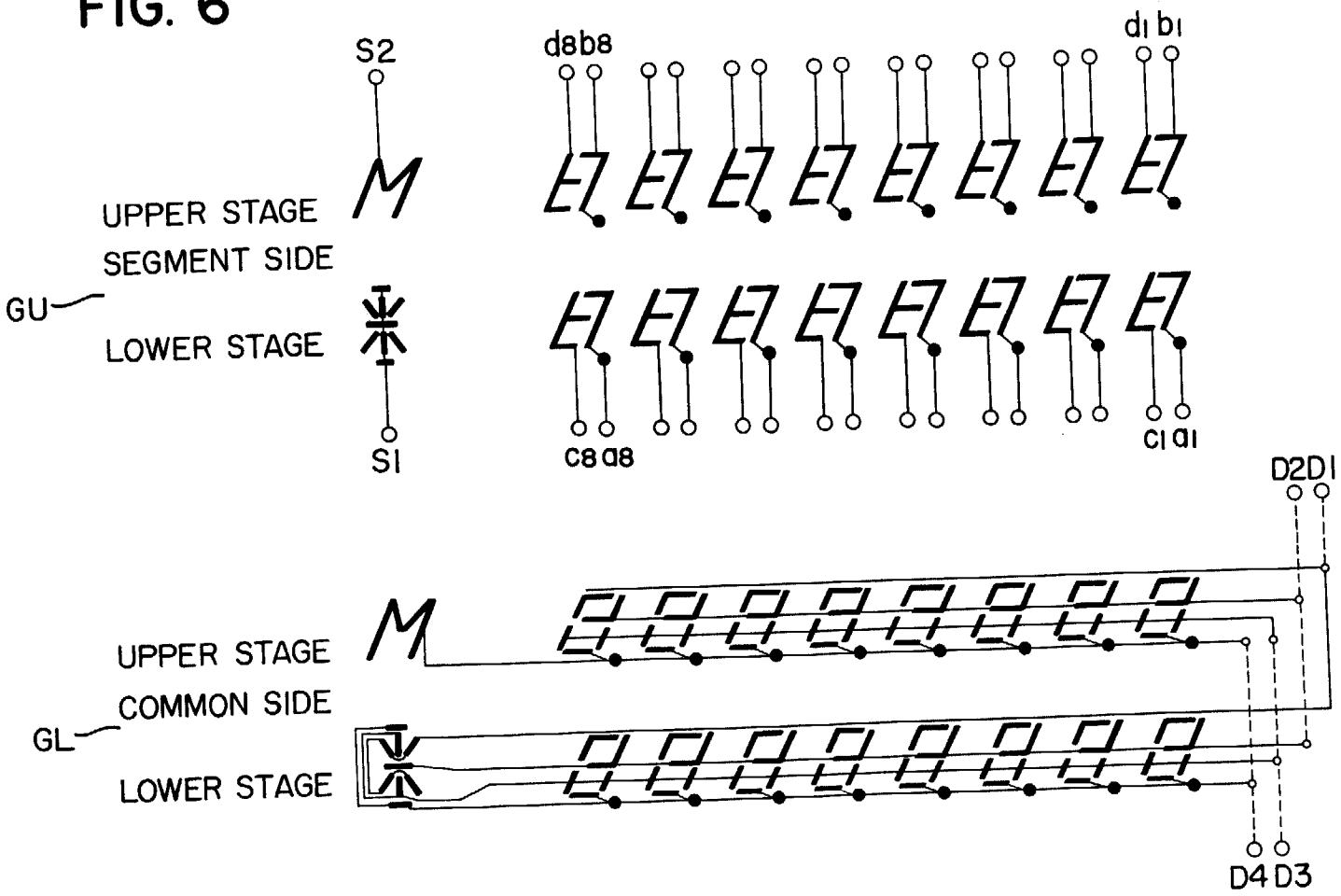
FIG. 6 is a plan view showing an another embodiment of the display device of the present invention.
Figure 7:
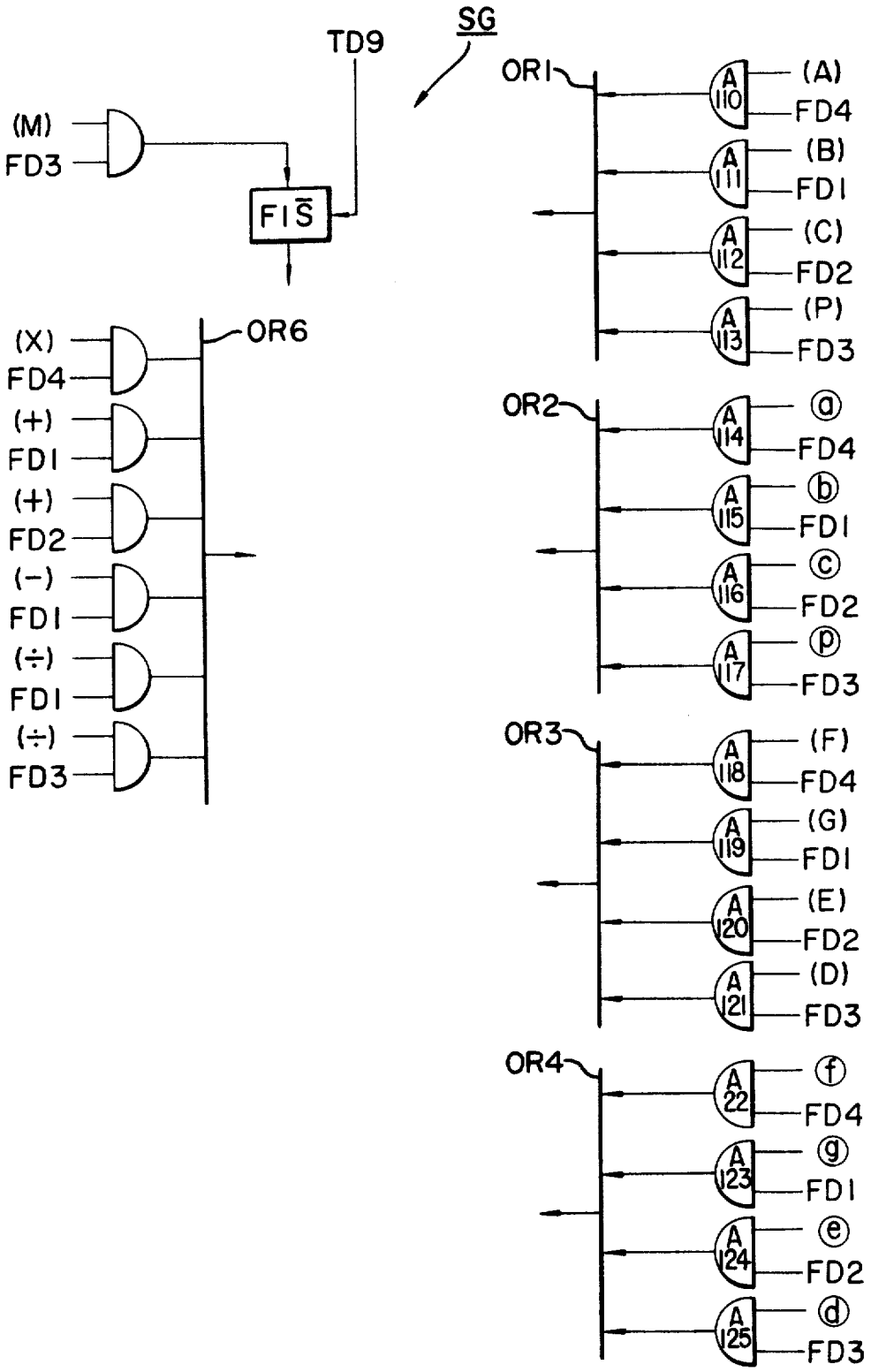
FIG. 7 is a drawing showing a part of the drive circuit therefor which is a modification of the circuit shown in FIG. 3.

FIG. 6 shows an another embodiment of the display device, and FIG. 7 shows a part of the circuit for driving said device, said circuit being a modification of the circuit shown in FIG. 3.

What we claim is

1. A numeral display device comprising:

a first board member including a first group of numerical display digits arranged in upper and lower stages, respectively, wherein each of the digits is formed in a figure eight pattern with a plurality of numerical segments, each digit being associated with a first decimal point segment, the first decimal point segment being electrically connected with at least one of the numerical segments of the associated digit;

a second board member in facing relationship with said first board member and including a second group of numerical display digits arranged in upper and lower stages, respectively, wherein each of the digits is formed in a figure eight pattern with a plurality of numerical segments, each digit being associated with a second decimal point segment, the second decimal point segment being electrically connected with at least one of the numerical segments of the associated digit which is different from the corresponding numerical segment connected with the first decimal point segment in said first board member;

a liquid crystal display material provided between said first and second board members; and selecting means for applying driving signals to each of said first and second groups of numerical display digits of said first and second board members to display numerical patterns, said selecting means comprising two registers, one of which stores binary information to be displayed on the upper stage of said numerical display digits, and the other of which stores binary information to be displayed on the lower stage of said numerical display digits, a converter for converting the binary information in said registers into segment information, a first group of latches for sequentially storing the output information from said converter, a second group of latches for storing the output information from said first group of latches, control means for causing said second group of latches to store the output information from said first group of latches at one time so that all segments are driven during the same period, and a pulse generator for generating pulses for periodically driving the segments on said second board member.

2. A numeral display device according to claim 1 wherein each of said first and second board members includes symbol mark segments which are located at one end of the numerical display digit arrangement in each of the upper and lower stages, and wherein at least one of the symbol mark segments of said second board member is electrically connected to at least one of the numerical segments forming a figure eight pattern and is periodically driven by said pulse generator.

3. A numeral display device comprising:

a first board member including a first group of numerical display digits each of which is formed in a figure eight pattern with a plurality of numerical segments, and being associated with a first decimal point segment, wherein the first decimal point segment is electrically connected with at least one of the associated numerical segments;

a second board member in facing relationship with said first board member and including a second group of numerical display digits each of which is formed in a figure eight pattern with a plurality of numerical segments, each digit being associated with a second decimal point segment, wherein each second decimal point segment is electrically connected with at least one of the associated segments other than those which correspond to the numerical segment connected with the first decimal point segment in said first board member;

a liquid crystal display material provided between said first and second board members; and selecting means for applying driving signals to each of said first and second groups of numerical display digits of said first and second board members to display numerical patterns, said selecting means comprising a register for storing binary information, a converter for converting the binary information in said register into segment informatin, a first group of latches for sequentially storing the output information from said converter, a second group of latches for storing the output information from said first group of latches, control means for causing said second group of latches to store the output information from said first group of latches at one time so that all the segments are driven during the same period, a pulse generator for generating pulses for periodically driving the segments on said second board member, and means for periodically changing the polarity of the voltage for driving said liquid crystal display material.

4. A numeral display device according to claim 3 wherein the segments in each display digit of the first group of numerical display digits are connected by a plurality of leads in such a manner that each lead connects a plurality of segments substantially perpendicular to the direction defined by the first group of display digits and forms a terminal itself, and the segments in each display digit of the second group of numerical display digits are connected by a plurality of leads in such a manner that each lead connects a plurality of segments substantially in the direction defined by the second group of display digits and forms a terminal itself.

5. A numerical display device according to claim 3 wherein at least one of said first and second board members is made of glass, and the segments and at least part or each lead are made of an electroconductive material.

6. A numeral display device according to claim 3 wherein each of said first and second board members includes symbol mark segments which are located at one end of the numerical display digit arrangement, at least one of the symbol mark segments of said second board member being electrically connected to at least one of the numerical segments forming a figure eight pattern and being periodically driven by said pulse generator.

* * * * *